US008708147B2

(12) United States Patent
Hansen et al.

(10) Patent No.: US 8,708,147 B2
(45) **Date of Patent: *Apr. 29, 2014**

(54) COMPOSITE PACKAGE

(71) Applicant: Display Pack, Inc., Grand Rapids, MI (US)

(72) Inventors: Victor D. Hansen, Rockford, MI (US); George E. Raimer, Saranac, MI (US); Michael J. Cramblet, Muskegon, MI (US); Kristie L. Vos, Marne, MI (US)

(73) Assignee: Display Pack, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/775,624

(22) Filed: Feb. 25, 2013

(65) Prior Publication Data

US 2013/0161220 A1 Jun. 27, 2013

Related U.S. Application Data

(63) Continuation of application No. 13/228,553, filed on Sep. 9, 2011, now Pat. No. 8,381,908, which is a continuation-in-part of application No. 13/167,507, filed on Jun. 23, 2011, now Pat. No. 8,622,216.

(51) Int. Cl.
*B65D 73/00* (2006.01)

(52) U.S. Cl.
USPC ..... 206/470; 206/463

(58) Field of Classification Search
USPC ..... 206/461–463, 470, 471, 472–475
See application file for complete search history.

(56) References Cited

U.S. PATENT DOCUMENTS

| | | | |
|---|---|---|---|
| 3,487,919 | A | 1/1970 | Elliott et al. |
| 3,743,081 | A | 7/1973 | Roberg et al. |
| 4,083,451 | A | 4/1978 | Hair |
| 4,240,544 | A | 12/1980 | Barnhart et al. |
| 4,498,589 | A | 2/1985 | Scott et al. |
| 4,499,353 | A | 2/1985 | Shields |
| 4,635,797 | A | 1/1987 | Bankier |
| 4,724,957 | A | 2/1988 | Burgschweiger |
| 4,779,734 | A | 10/1988 | Kydonieus |
| 4,892,195 | A | 1/1990 | Slavin et al. |
| 4,901,884 | A | 2/1990 | Kallenbach |
| 5,568,863 | A | 10/1996 | Weavers |

(Continued)

FOREIGN PATENT DOCUMENTS

GB 2091692 A * 8/1982

*Primary Examiner* — Bryon Gehman

(74) *Attorney, Agent, or Firm* — Warner Norcross & Judd LLP

(57) ABSTRACT

A composite package having a folded paperboard card and two plastic components shaped to interfit with one another when the package is closed. The plastic components define a space for containing one or more articles. The folded paperboard card may be a dual-panel card with two panels joined to one another along a fold line or other hinge. Each paperboard panel may define an opening to seat a plastic component. The paperboard is configured to bring the two plastic components into registration when the panels are folded together along the hinge. The plastic components may be configured to releasably interlock with one another when the package is closed. One of the two plastic components may include a shoulder that is configured to be snap-fitted or otherwise frictionally into the other plastic component. The opening may include a seat shaped to closely receive and provide a stop for the shoulder.

20 Claims, 12 Drawing Sheets

(56) References Cited

U.S. PATENT DOCUMENTS

| | | | |
|---|---|---|---|
| 5,769,217 | A | 6/1998 | Derraugh et al. |
| 5,775,512 | A | 7/1998 | Jones et al. |
| 5,839,575 | A | 11/1998 | Blanco |
| 6,308,832 | B1 | 10/2001 | Pirro et al. |
| 6,715,607 | B2 | 4/2004 | Wetsch |
| 6,959,809 | B2 | 11/2005 | Begim |
| 7,621,405 | B2 | 11/2009 | Schweitzer et al. |
| 7,931,148 | B2 | 4/2011 | Hansen et al. |
| 2004/0163990 | A1 | 8/2004 | Begim |
| 2005/0173286 | A1 | 8/2005 | Hansen |
| 2007/0163911 | A1 | 7/2007 | Gelardi |
| 2011/0168731 | A1 | 7/2011 | Hansen et al. |
| 2011/0290675 | A1 | 12/2011 | Shiue et al. |

* cited by examiner

COMPOSITE PACKAGE

FIELD OF THE INVENTION

The present invention relates to packaging, and more particularly to paperboard and plastic composite package structures intended for use in containing and displaying articles at the point of sale.

BACKGROUND OF THE INVENTION

A wide variety of composite packages are used to contain and display articles at the point of sale. A conventional composite package includes a combination of paperboard and plastic components. There is a variety of types of composite packages in which the paperboard and plastic components are combined in different ways. For example, "book-style" composite packages are shown in U.S. Pat. No. 5,775,512 to Hones and U.S. Pat. No. 4,724,957 to Burgschweiger. A conventional "book-style" composite package include an inner plastic clam shell that forms a compartment to contain the article(s) to be packaged and an outer paperboard cover that covers the clam shell. The clam shell and paperboard each include an integral "spine." The spines are generally coextensive to allow the package to be opened and closed along one edge in a book-like manner. Book-style composite packages provide the benefits of being easily recloseable and relatively stable constructions, but they can be relatively expensive to manufacture. Further, the paperboard spine, which spans the thickness of the package, may be too flexible to provide confident registration between the clam shell portions, particularly after repeated opening and closing.

Another type of composite package is a blister package. Blister packages are used to package a wide range of articles. A conventional blister package includes a plastic component (or blister) having a peripheral flange that is face-sealed to a paperboard card or sandwiched between a pair of paperboard panels. In some cases, the two paperboard panels are a single piece of paperboard folded along an edge. In other cases, they are two separate panels. Various attempts have been made to provide recloseable blister packages. In one type of recloseable blister package, the blister is formed with an integral door. With this construction, the blister remains sealed to the paperboard and a door within the blister is opened. In another type of recloseable blister package, the blister is secured to the paperboard in a way that allow the blister to pivot away from the paperboard. For example, one edge of the blister may be permanently sealed to the paperboard and the other three edges may be joined only by a peelable adhesive. This allows the blister to open while remaining joined to the paperboard. In yet another example, the paperboard panel closing the blister may include a door, such as a perforated region that can be opened to gain access to the interior of the blister.

Although existing composite packages are suitable for many applications, there remains a desire for a stable and easily reclosable package that is less expensive to manufacture and provides a wide range of packaging options.

SUMMARY OF THE INVENTION

The present invention provides a composite package having a folded paperboard card and two plastic components shaped to interfit with one another when the package is closed. The plastic components define a space for containing one or more articles. The folded paperboard card may be a dual-panel card with two panels joined to one another along a fold line or other hinge. Each paperboard panel may include an opening to seat a plastic component. The openings are configured to bring the two plastic components into registration when the panels are folded together along the hinge.

In one embodiment, the plastic components are configured to releasably interlock with one another when the package is closed. One of the two plastic components may include a shoulder that is configured to be snap-fitted into the opening of the other plastic component. The opening may include a shelf shaped to closely receive the shoulder and provide a stop against which the shoulder abuts when the package is closed.

In one embodiment, the shoulder and opening include interfitting contours that provide a snap-fit. The configuration of the snap-fitting features may be set to provide the desired resistance to opening and closing.

In one embodiment, each of the plastic components includes a peripheral flange sealed to the corresponding panel. The flanges may be sealed to the inside surfaces of the panels so that the flanges are hidden from view when the package is closed. The flanges may be joined to one another along an integral hinge seated in the interior of the paperboard fold line.

The present invention provides an inexpensive and effective recloseable composite package. The use of interfitting plastic components provides a stable package with an extended life. The interfitting plastic components can be designed with contours that provide the desired amount of resistance to opening and closing. Further, the fold line provides substantially more stability than offered by the paperboard "spine" of book-style composite packages. The present invention may also be used to provide a package with the aesthetically pleasing appearance of a blister package. In those embodiments in which the plastic components are separate from one another, the paperboard hinge does not bind against an underlying plastic hinge and the amount of plastic used to manufacture the package is reduced.

These and other features of the invention will be more fully understood and appreciated by reference to the description of the embodiments and the drawings.

Figure 1A:
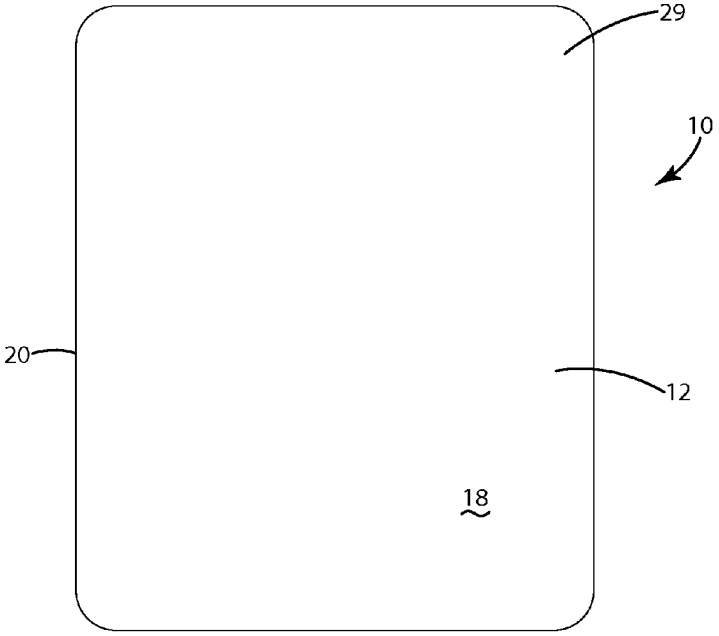
FIG. 1A is a top view of a blister package in the closed position in accordance with a first embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DESCRIPTION OF CURRENT EMBODIMENTS

A composite package in accordance with a first embodiment of the present invention is shown in FIGS. 1-6 and generally designated 10. The composite package 10 generally includes a paperboard portion 12 and a plastic portion 14. The paperboard portion 12 of this embodiment includes two panels 16 and 18 that are joined along a fold line 20. The plastic portion 14 of this embodiment includes two plastic components 26 and 28 joined via an integral hinge adjacent the fold line 20. The plastic components 26 and 28 are configured to interfit with one another to cooperatively define an article containing space, and each plastic component 26 and 28 is interconnected with a different panel 16 and 18. The plastic components 26 and 28 are positioned in the panels 16 and 18 so that they come into engagement with each other when the panels 16 and 18 are closed along the fold line 20. In use, the composite package 10 can be opened and closed along the paperboard fold line 20 to open and close the plastic components and selectively provide access to the contents. Although the present invention is described in connection with a composite package having two plastic components that cooperatively define a single generally rectangular space for holding articles, the configuration may vary from application to application. For example, the number, size, shape and configuration of plastic components may vary from application to application. It should also be noted that the present invention is described in connection with a display package intended primarily for use in holding and displaying articles at the point of sale. For example, the packages may be placed on a store shelf or hung from a display hook in a store where they are visible to consumers. The package is capable of being repeatedly opened and closed, and therefore may be used by consumers as a storage container. For example, the package may contain a supply of articles and the consumer may use the package as a storage container for articles until all of them have been consumed. A consumer may also reuse the package to store other articles. Directional terms, such as top, bottom, up, down, right, left, front, rear, inner and outer are used as expedients to denote directions with respect to the orientation of the composite package and package components in the drawings. The use of these directional terms should not be interpreted to limit the present invention to use in any specific orientation or configuration.

As noted above, the paper board portion 12 of the illustrated composite package 10 includes a pair of paperboard panels 16 and 18 that are joined along a fold line 20. The paperboard portion 12 of this embodiment is rectangular shape and includes a fold line 20 that divides the paperboard portion 12 into two essentially identical rectangular panels 16 and 18. The fold line 20 may be defined by a score line, a partial cut line or a series of perforations, if desired, so that the cover 12 may be easily folded in a controlled manner when the package 10 is closed.

Figure 3:
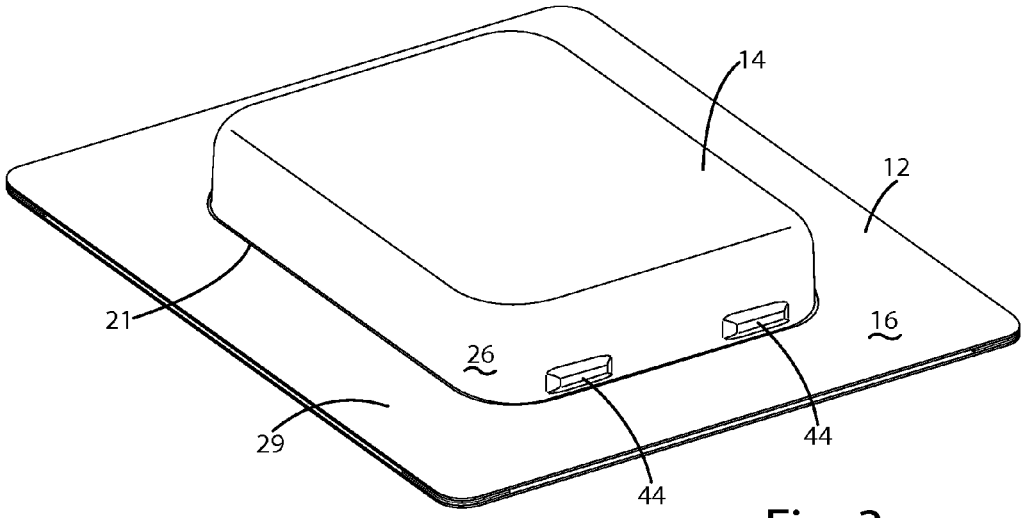
FIG. 3 is a perspective view of the package of FIGS. 1-2 in the closed position.

In the illustrated embodiment, the first panel 16 defines an opening or cut-out 21. As shown in FIG. 3, the cut-outs 21 is configured to receive a raised portion of the first plastic components 26. For example, the cut-out 21 may be sized and shaped to match the contours of the raised plastic pocket 26. In alternative embodiments, the cut-out may have another shape. The cut-out 21 is generally located substantially between the fold line 20 and the lateral edges of the panel 16. The cut-out 21 is positioned to come into alignment with the plastic component 26 when the paperboard portion 12 is folded into the closed position bringing the panels 16 and 18 in opposition.

Figure 1B:
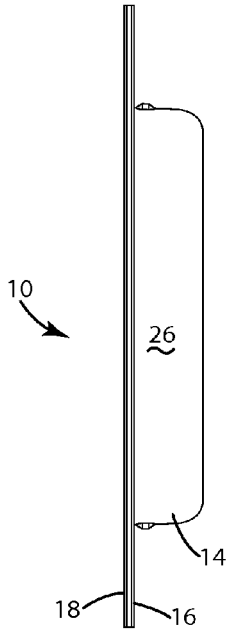
FIG. 1B is a right side elevational view of a blister package in the closed position in accordance with the first embodiment.
Figure 1C:
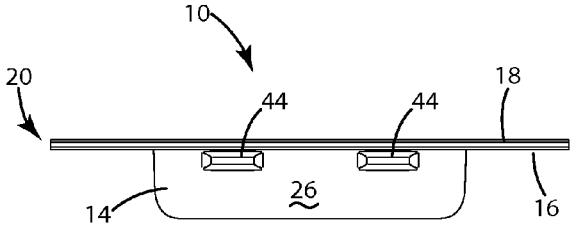
FIG. 1C is a front view of a blister package in the closed position in accordance with the first embodiment.
Figure 2A:
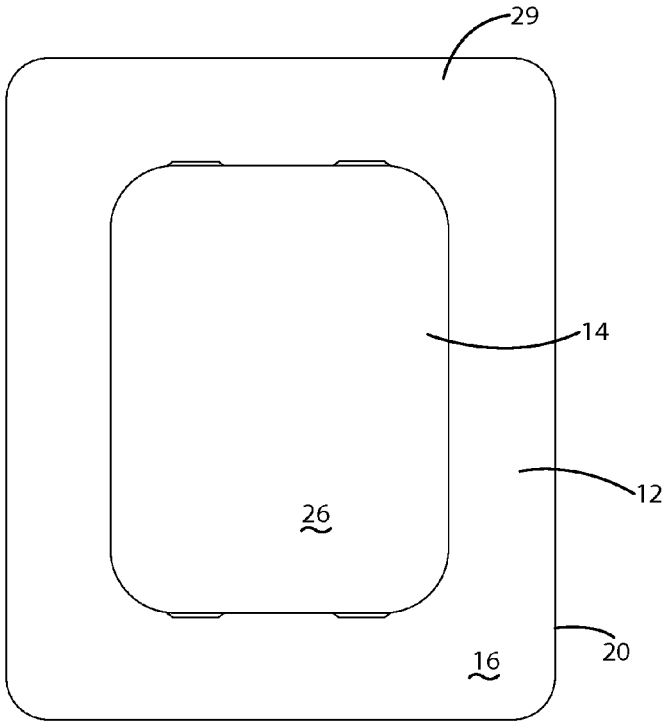
FIG. 2A is a bottom view of the blister package of FIG. 1A in the closed position.
Figure 2B:
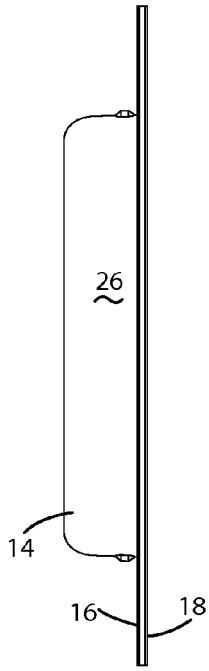
FIG. 2B is a left side elevational view of the blister package of FIG. 1A in the closed position.
Figure 2C:
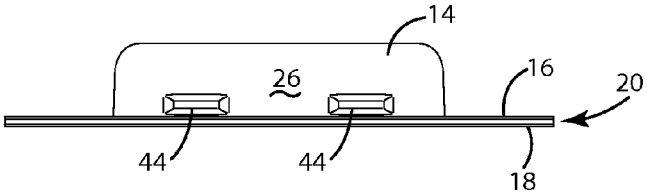
FIG. 2C is a rear view of the blister package of FIG. 1A in the closed position.
Figure 6:
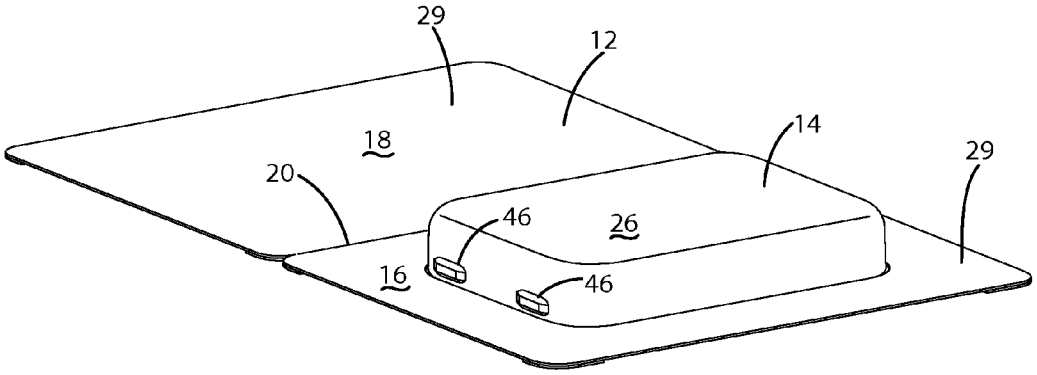
FIG. 6 is a second perspective view of the package of FIGS. 1-2 in the open position.
Figure 7A:
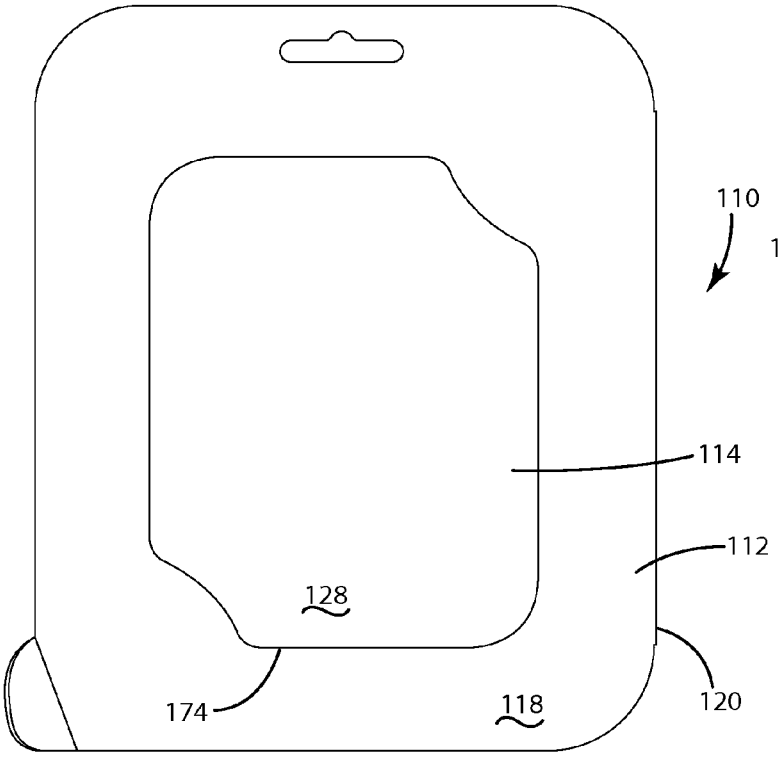
FIG. 7A is a top view of a blister package in the closed position in accordance with a second embodiment of the present invention.
Figure 7B:
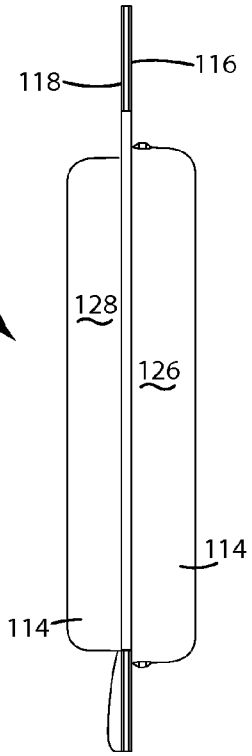
FIG. 7B is a right side elevational view of a blister package in the closed position in accordance with the second embodiment.
Figure 7C:
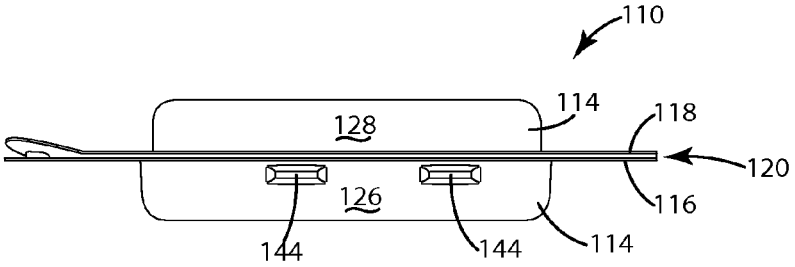
FIG. 7C is a front view of a blister package in the closed position in accordance with the second embodiment.
Figure 8A:
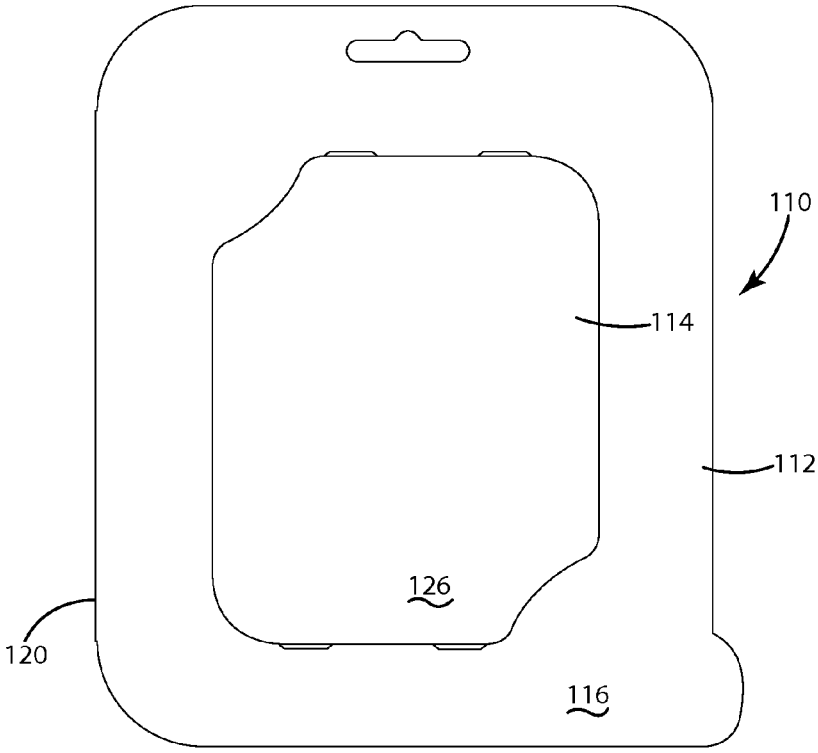
FIG. 8A is a bottom view of the blister package of FIG. 7A in the closed position.
Figure 8B:
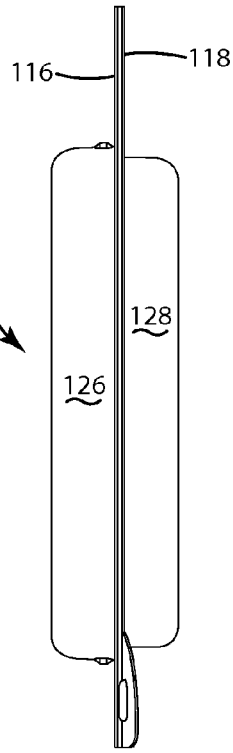
FIG. 8B is a left side elevational view of the blister package of FIG. 7A in the closed position.
Figure 8C:
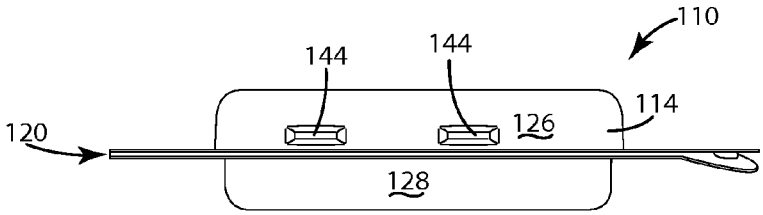
FIG. 8C is a rear view of the blister package of FIG. 7A in the closed position.
Figure 9:
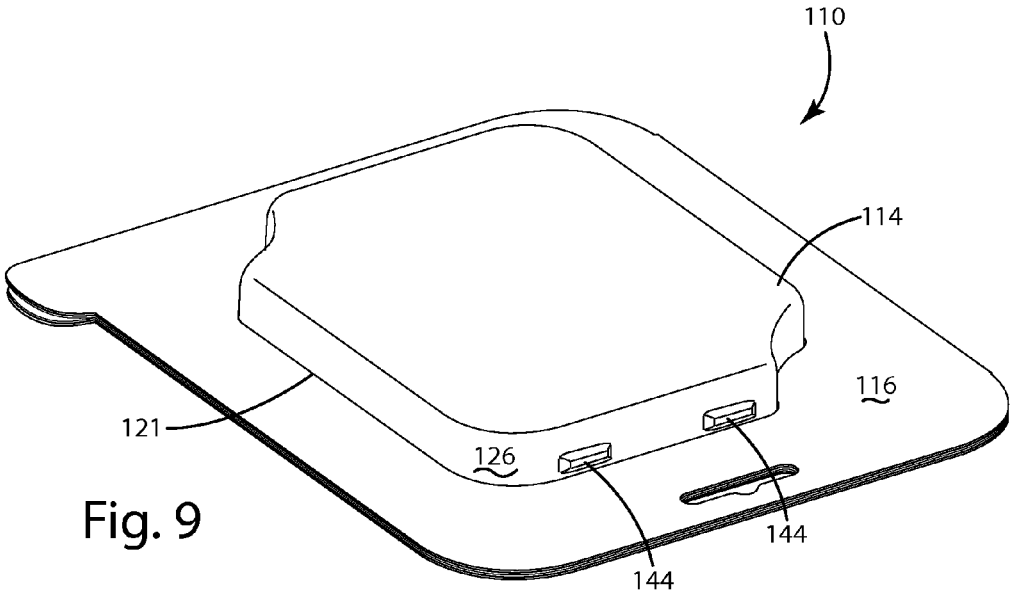
FIG. 9 is a perspective view of the package of FIGS. 7-8 in the closed position.
Figure 10:
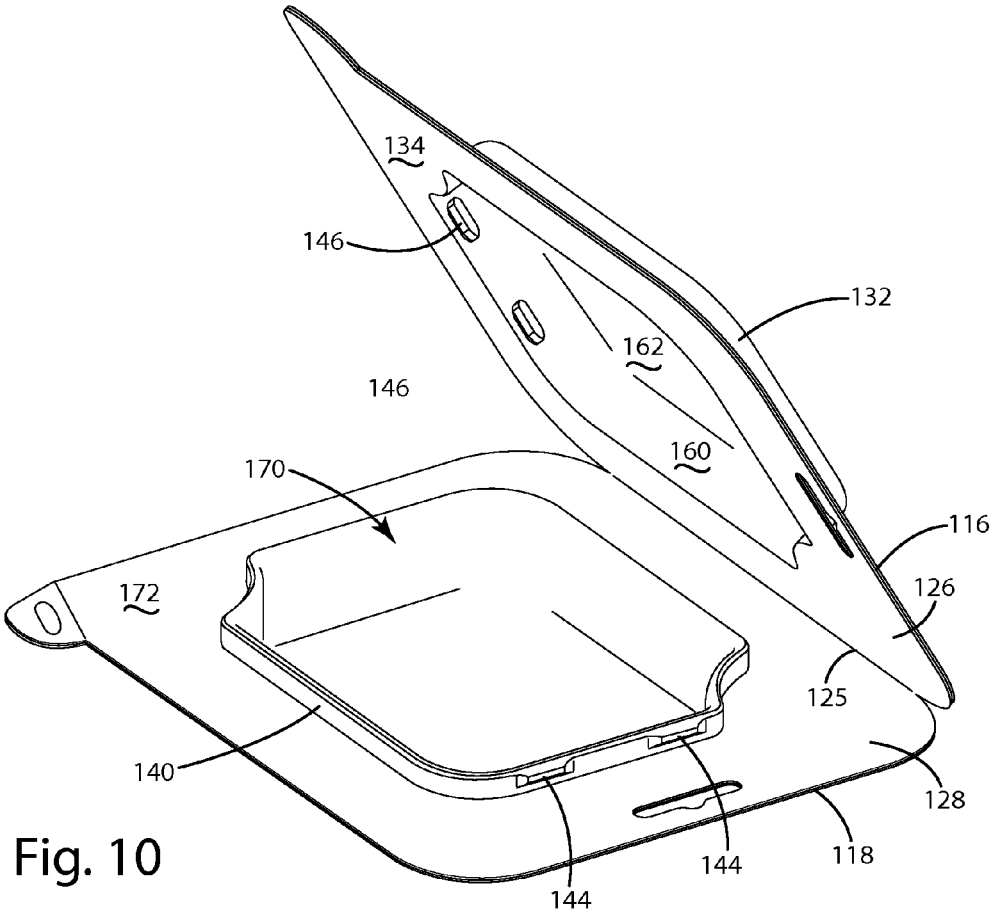
FIG. 10 is a first perspective view of the package of FIGS. 7-8 in the open position.
Figure 11:
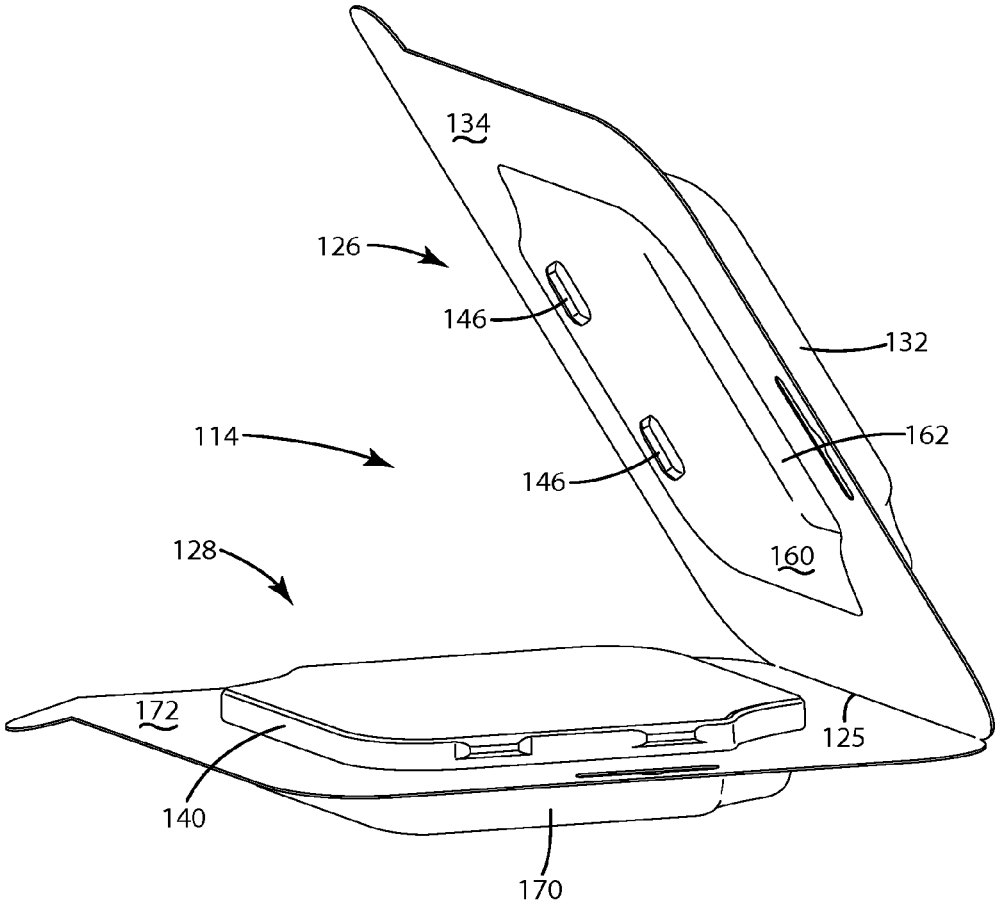
FIG. 11 is a perspective view of the inner plastic portion of the package of FIGS. 7-8 in the open position.

Shown in FIGS. 1-2 and 6, the paperboard portion 12 includes an outer major surface 29 that may be adapted to receive printed graphics, and an inner major surface 30 (shown in FIG. 4) that is capable of receiving a conventional adhesive and may also receive printed graphics. The surfaces 29 and 30 may or may not include a coating such as a varnish or other commonly used paperboard coating.

Although the illustrated paperboard portion 12 is generally rectangular, the paperboard portion 12 may have essentially any shape that allows two panels to be folded into opposition. The illustrated panels 16 and 18 are joined along a fold line 20, but may alternatively be joined in other ways. For example, the panels may be separately manufactured and joined together by a material capable of functioning as a hinge, such as a strip of tape or other flexible adhesive material. The illustrated package 10 includes two panels, but the package may alternatively include more than two panels. For example, the package may include three panels with two panels that fold to cover different regions of the third panel. During manufacture, the paperboard portion 12 may be manufacture from a paperboard blank that is die-cut or otherwise formed from paperboard stock of the desired type and thickness. If the paperboard portion 12 is formed as a single continuous piece of stock, a score line or perforations may be formed in the blank to facilitate folding along the desire fold line 20.

Figure 4:
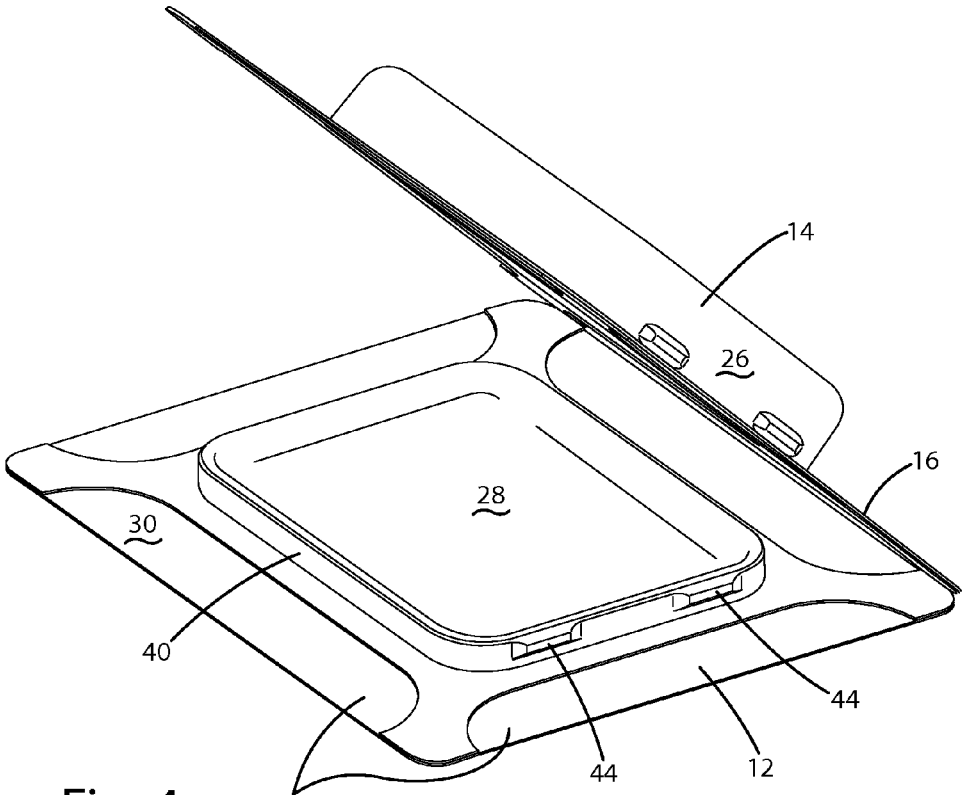
FIG. 4 is a first perspective view of the package of FIGS. 1-2 in the open position.
Figure 5:
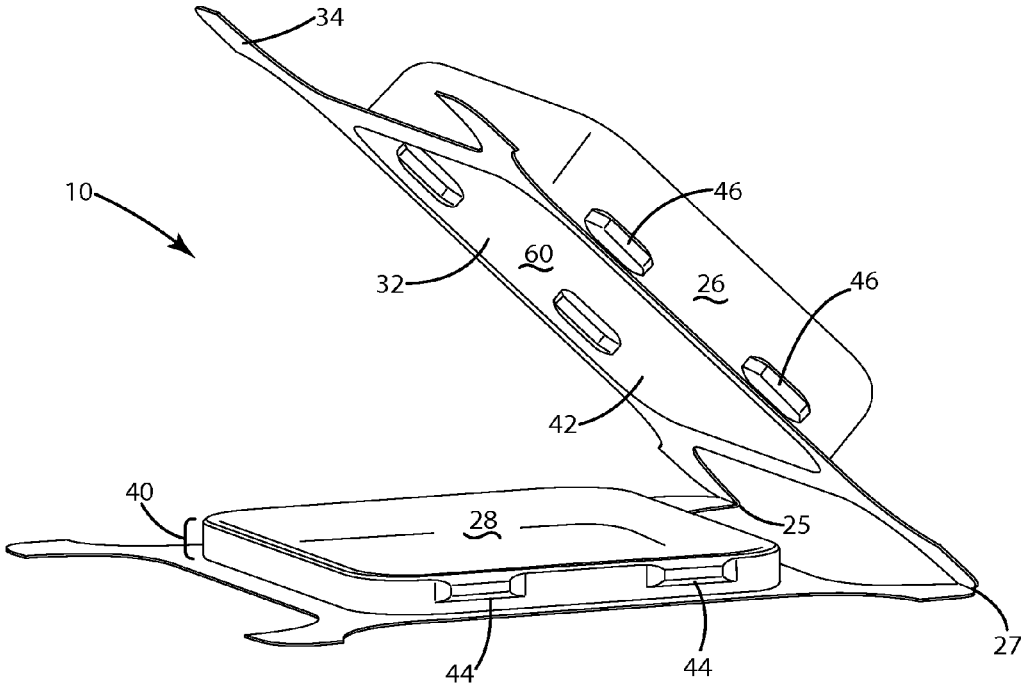
FIG. 5 is a perspective view of the plastic portion of the package of FIGS. 1-2 in the open position.

The plastic portion 14 may be constructed from a polymer such as polyvinyl chloride (PVC), Barex®, copolyester or any other plastic material that can be thermoformed or otherwise shaped to create the desired compartment for containing one or more articles. In the illustrated embodiment, the polymer is substantially transparent, but it may be translucent or opaque in other applications if desired. The unitary plastic portion 14 includes two plastic components 26 and 28, each of which is secured to a different panel 16 and 18, respectively. The front package component 26 and the rear package component 28 may be formed from a single sheet of plastic and may be joined by one or more segments of plastic. As perhaps best shown in FIG. 5, the plastic components 26 and 28 are joined along first and second integral hinges 25 and 27. The integral hinges 25 and 27 are of a closed C-type structure nested or seated within the interior of the paperboard fold line 20. The plastic components 26 and 28 are pivotable with respect to each other about the hinges 25 and 27 between a first, closed position as show in FIGS. 1-3 and a second, open position as shown in FIGS. 4-6. While shown as having multiple hinges 25 and 27, the plastic components 26 and 28 may instead be joined along a single, continuous integral hinge.

Referring again to FIG. 5, the front plastic component 26 is generally rectangular in shape and includes a raised pocket 32 and a flange 34. The pocket 32 is shaped to provide the desired space for containing the articles to be packaged. In this illustrated embodiment, this is a single compartment capable of receiving articles. In other applications, the front plastic component 26 may define a plurality of separate compartments. The pocket 32 may be shaped to correspond in shape with and closely receive the article(s) to be packaged. The pocket 32 may alternatively be shaped to loosely receive the article or articles. For example, the pocket 32 may be a rectangular pocket capable of containing a plurality of fasteners, such as nails or screws. In the illustrated embodiment, the outer dimensions of the pocket 32 at its conjunction with the flange 34 are substantially the same as the inner dimensions of the corresponding cut-out 21. Although the close fit between the pocket 32 and the cut-out 21 helps to register the front plastic component 26 with respect to the panel 16, a close fit is not required and the pocket 32 need not correspond in shape with the cut out. For example, if the outer dimensions of the pocket 32 are substantially smaller than then inner dimensions of the cut-out 21, the flange 34 may bridge the space between the pocket 32 and the panel 16 surrounding the cut-out 21.

The flange 34 of the illustrated embodiment extends entirely around the periphery of the pocket 32 to provide a continuous section of material along which the front plastic component 26 may be joined to the panel 16. The flange 34 need not, however, be continuous, and it may alternatively be a single incomplete segment or it may be broken into multiple segments disposed at different locations around the periphery of the pocket 32. The flange 34 may be joined to the panel 16 in essentially any way. In the illustrated embodiment, the flange 34 is secured to the panel 16 by a heat-activated adhesive, but other types of adhesives may be used. An adhesive may be extend along any regions where the plastic component 14 and the paperboard portion 12 are in contact, but in the illustrated embodiment extends along the interface between the panel 16 and the flange 34. In the illustrated embodiment, the plastic component 14 is disposed with the flange 34 engaging the inside surface 30 of the panel 16 and the pocket 32 extending outwardly through the cut-out 21.

Although the front package component 26 and the rear package component 28 are shown as joined along a bridge or a hinge 25, the package components 26 and 28 may be separate components. In addition, the number of plastic components may vary from application to application. For example, each panel may have a plurality of cut-outs that are fitted with a plurality of plastic components. In some embodiments, each front and rear pair of plastic components can define a separate article containing space. In other embodiments, the plastic components are not arranged in unique pairs. For example, two or more components on one panel may be fitted into a single plastic component on an opposed panel.

In the illustrated embodiment, the front plastic component 26 and the rear plastic component 28 are configured to be interfitted with one another. In the package of FIGS. 1-6, one of the plastic components 26 and 28 may be shaped to include a shoulder 40 and the other may be shaped to include a seat 42 adapted to receive the shoulder 40. Although the shoulder 40 and seat 42 may be on the same plastic components, in the illustrated embodiment, the shoulder 40 is part of the rear plastic component 28 and the seat 42 is part of the front plastic component 26. As shown in FIG. 5, the shoulder 40 of this embodiment protrudes from the rear plastic component 28 and is configured to be closely fitted into the seat 42 in the front plastic component 26. The seat 42 of this embodiment includes a sidewall 60 and a base 62. The sidewall 60 is sized and shaped to correspond with and closely receive the shoulder 40 protruding from the rear plastic component 28. The base 62 is configured to engage and support the shoulder 40 when the plastic components are interfitted. The shoulder 40 and seat 42 may be intersecured by a friction fit, and the amount of force required to join and separate the components may vary from application to application as desired. In some applications, protrusions 44 and catches 46 may also be included in the shoulder 40 and seat 42 to assist in holding the package 10 closed. In use, the protrusions 44 and catches 46 frictionally interfit when the package 10 is closed to retain the package 10 in the closed position.

A composite package in accordance with a second embodiment of the present invention is shown in FIGS. 7-11 and generally designated 110. Except as expressly described herein, the composite package 110 is similar to composite package 10, and the features of package 110 which correspond to the features of package 10 are designated by the corresponding reference numerals increased by 100. For example, the paperboard portion 112 and the plastic portion 114 correspond to the paperboard portion 12 and the plastic portion 14. Only the elements that differ significantly are described below The plastic portion 114 is generally similar to the previously described second plastic portion 14 with the exception that it defines a second raised portion or pocket 170 extending rearwardly with respect to a second flange 172. In addition, each flange 134, 172 is generally coextensive with the corresponding paperboard panel 116, 118. The paperboard portion 112 is generally similar to the previously described paperboard portion 12 with the exception that it defines a second opening or cut-out 174 shaped to receive the rearwardly extending pocket 170. As described above in connection with the first embodiment, the rearwardly extending pocket 170 may be shaped to loosely receive the article or articles. For example, the pocket 170 may be a rectangular pocket capable of containing a plurality of fasteners, such as nails or screws. In the illustrated embodiment, the outer dimensions of the pocket 170 at its conjunction with the flange 172 are substantially the same as the inner dimensions of the corresponding cut-out 174. Although the close fit between the pocket 170 and the cut-out 174 helps to register the rear plastic component 128 with respect to the rear panel 118, a close fit is not required and the rear pocket 170 need not correspond in shape with the cut out 174. For example, if the outer dimensions of the pocket 170 are substantially smaller than then inner dimensions of the cut-out 174, the flange 172 may bridge the space between the pocket 170 and the panel 118 surrounding the cut-out 176.

Like the front plastic component 126, the rear plastic component 128 is shown in FIGS. 7-11 as being generally rectangular in shape and includes a pocket 132 and a flange 134. The plastic components 126 and 128 may, however, be other shapes depending on the desired function and the articles to be held in the package 110. The rear plastic component 128 may to include any or all of the alternative features described above in connection with the front plastic component 126, and vice versa.

Figure 12:
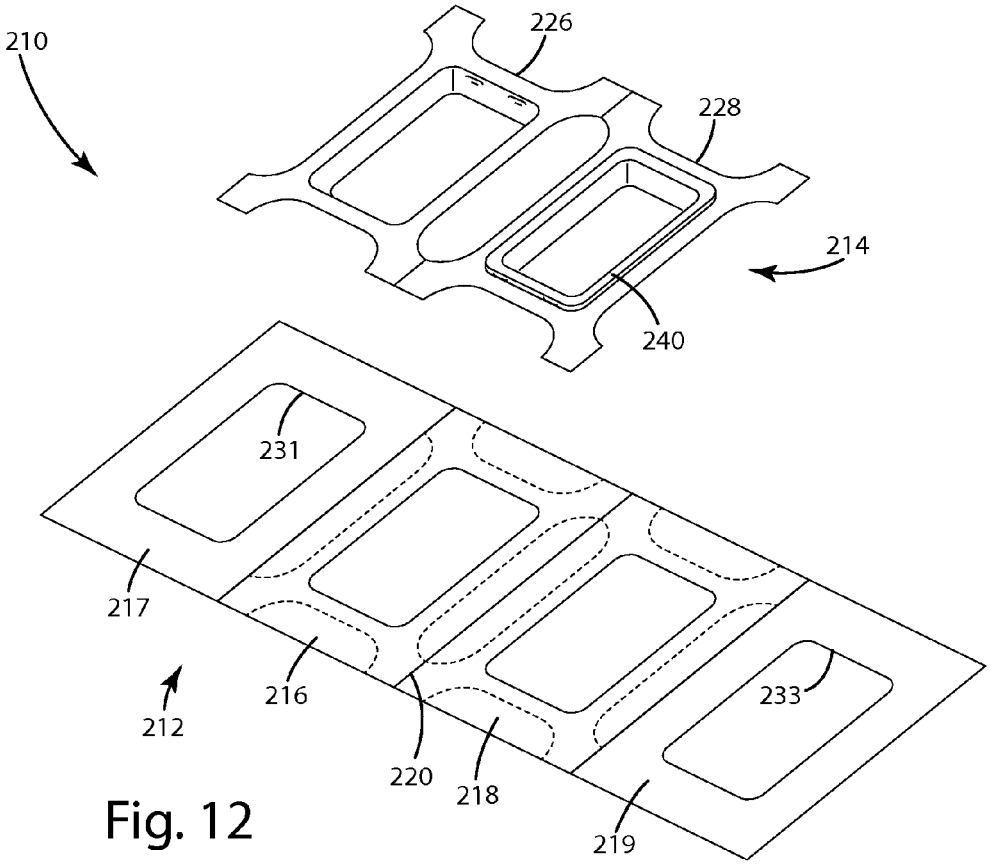
FIG. 12 is an exploded perspective view of an alternative package showing the plastic portion positioned above the paperboard panels.
Figure 13:
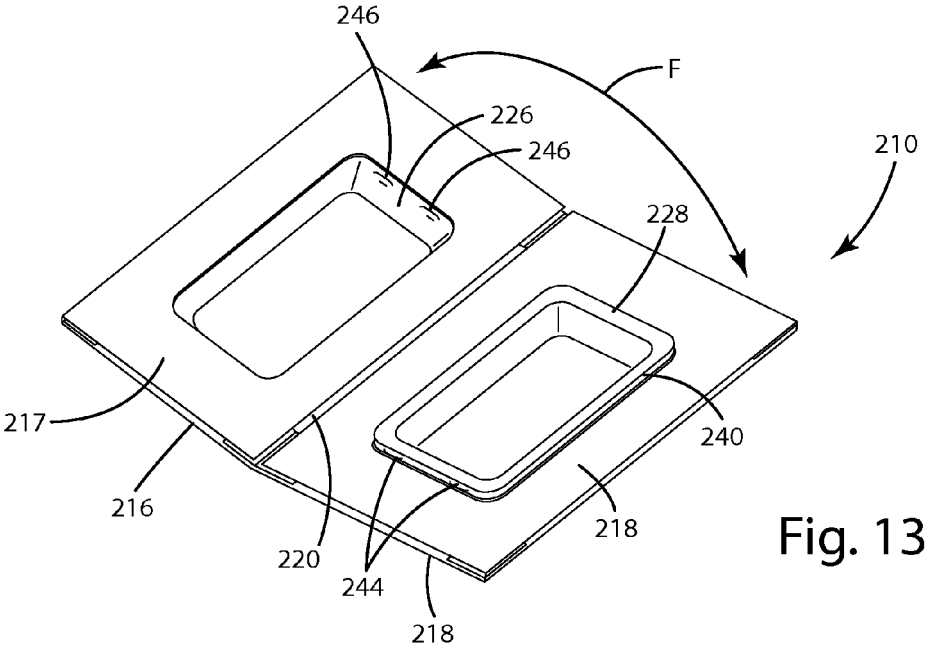
FIG. 13 is a perspective view of the alternative package of FIG. 12 showing the outer panels folded over the inner panels.

FIGS. 12 and 13 show another alternative embodiment. In this embodiment, the package 210 includes a paperboard portion 212 with four panels 216, 217, 218 and 219 that cooperate with the plastic portion 214 to form the package 210. FIG. 12 shows the plastic portion 214 positioned over the paperboard portion 212. The plastic portion 214 includes fold line 225 and 227 that extends through the segments joining the two plastic components 226 and 228. The broken lines of FIG. 12 show where the plastic portion 214 is to be positioned in the paperboard portion 212. In the illustrated embodiment, the outermost panels 217 and 218 fold inwardly onto the innermost panels 216 and 218 to trap/hold the plastic portion 214 in place. Although the hinges between the various panels are parallel in the illustrated embodiment, the outermost panels may be joined to the innermost panels along any other free edge, such as the top or bottom edges. The outermost panels 217 and 219 define openings 231 and 233, respectively, that will align with the front package component 226 and the rear package component 228. In this embodiment, opening 231 is sized, shaped and positioned to align and correspond with the opening of the front package component 226. The opening 233 of this embodiment is sized, shaped and positioned to align and interfit with the shoulder 240 of the rear package component 228. As can be seen, in this embodiment, the openings 231 and 233 are configured so that the outermost panels do not interfere with the article containing space or the interfitting of the plastic components 226 and 228.

Once folded, the innermost panels 216 and 218 and outermost panel 217 and 219 may be joined in essentially any suitable manner, such as through the use of adhesives and cements. In the illustrated embodiment, the mating surfaces of the panels 216, 217, 218 and 219 are joined by a cohesive, such as a rubber-based or latex-based cohesive. More specifically, in this embodiment, the mating surfaces of the panels 216, 217, 218 and 219 are coated with a cohesive so that, once folded, panel 216 adhesively joins to panel 217 and panel 218 adhesively joins to panel 219.

The package 210 can then be opened and closed by bending along fold line 220 as shown by line F of FIG. 13. The fold line 220 may be essentially any form of fold line. However, in some embodiments, it may be desirable to use a wider fold line that is configured to accommodate the thickness of the extra panels 217 and 218. For example, in an application where the fold line 220 is formed by a crease score, the crease score may have a width ranging between 0.010" and 0.1". The fold line in the plastic portion 214 may also be wider to accommodate the thickness of the extra panels 217 and 218. In use, the shoulder 240 of the rear plastic component 228 can be fitted into the front plastic component 226. The components may be configured to snap-lock together. For example, in the illustrated embodiment, the shoulder 240 may include protrusions 244 and the front plastic component 226 may include catches 246 configured to receive the catches 246 when the package 210 is closed.

The extra panels provided in this embodiment can facilitate assembly of the package 210 because the plastic portion 214 can be secured in place without the use of expensive sealing equipment. Instead, the package 210 can be manually assembled simply by folding the outermost panels onto the innermost panels so that the cohesive secures them together. Further, the extra panels increase the strength/stiffness of the package 210. Also, because the extra panels are folded, they allow printing to appear on all visible sides of the package 210 even when printing is applied to only one side of the paperboard portion 212.

Figure 14:
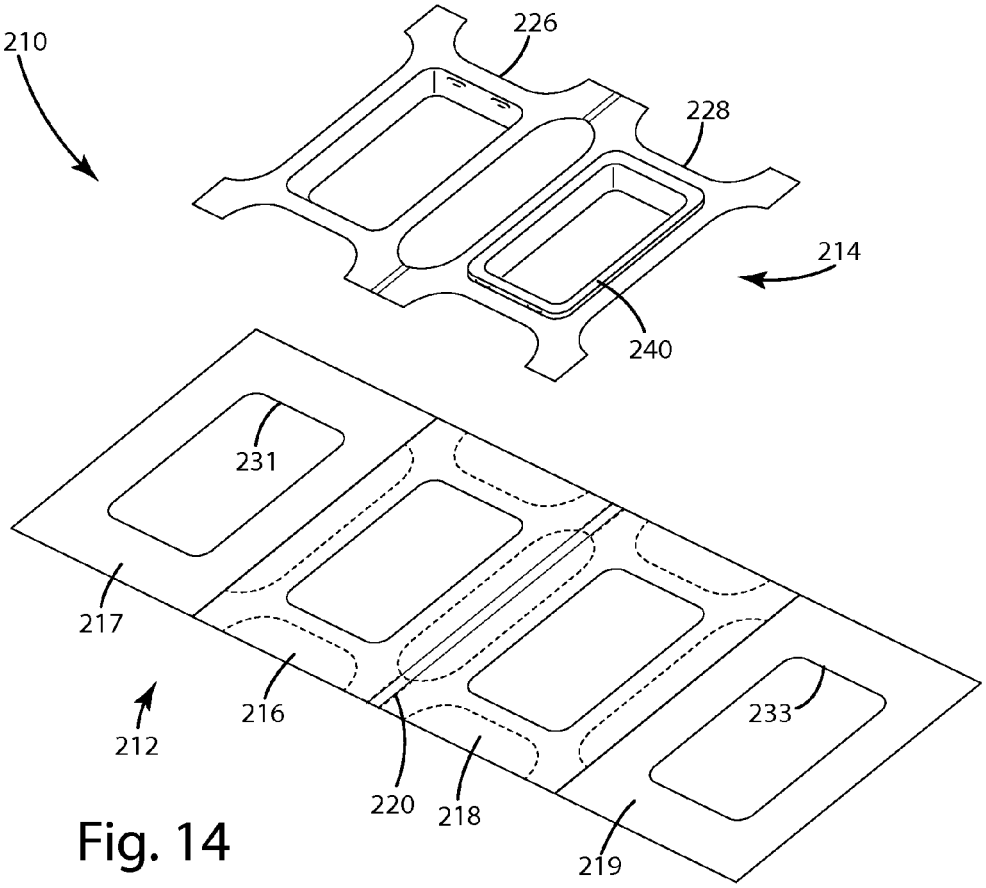
FIG. 14 is a perspective view of another alternative package having a paper component with a double hinge showing the plastic portion positioned above the paperboard panels.
Figure 15:
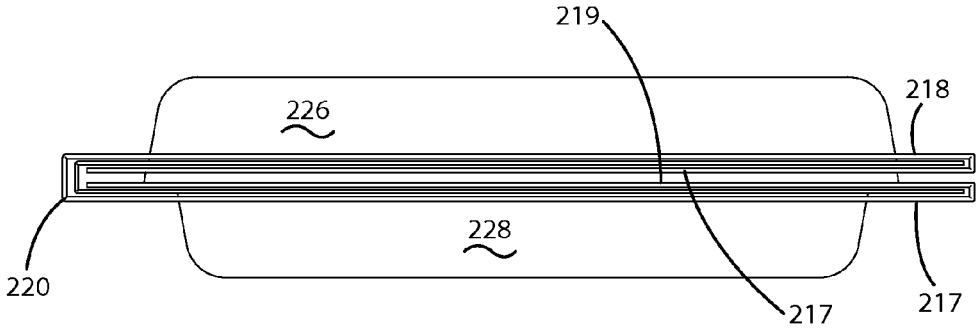
FIG. 15 is a front view of the alternative package of FIG. 14.

Another alternative embodiment is shown in FIGS. 14-15. In this embodiment, the paperboard portion 212' and the plastic component 214' each include a "double hinge" to accommodate the thickness of extra panels 217' and 219'. In this embodiment, the double hinges are formed by two spaced apart fold lines. For example, the paperboard portion 212' of this embodiment includes two parallel fold lines 220' and the plastic portion 214' includes two parallel fold lines 225' and 227'. As perhaps best shown in FIG. 15, the double hinges provide the package 210' with something of a square hinge for both the paperboard potion 212' and the plastic portion 214'. The spacing between the pairs of fold lines 220', 225' and 227' may be selected to roughly correspond with the thickness of the package 210'. For example, the spacing between the two lines that form hinge 220' may be selected to correspond with the combined thickness of the flanges of the plastic portion 214' and the extra panels 217' and 219' of the paperboard portion 212', and the two lines that form hinges 225' and 227' may be selected to correspond with the thickness of the extra panels 217' and 219'. As a result, in this example, the panels 216', 217', 218' and 219' and the flanges of the plastic portion 214' closely overlie and extend substantially parallel to one another when the package 210' is closed. The various fold lines may be defined by a score line, a partial cut line or a series of perforations, if desired, so that the package 210' may be easily folded in a controlled manner.

Figure 16:
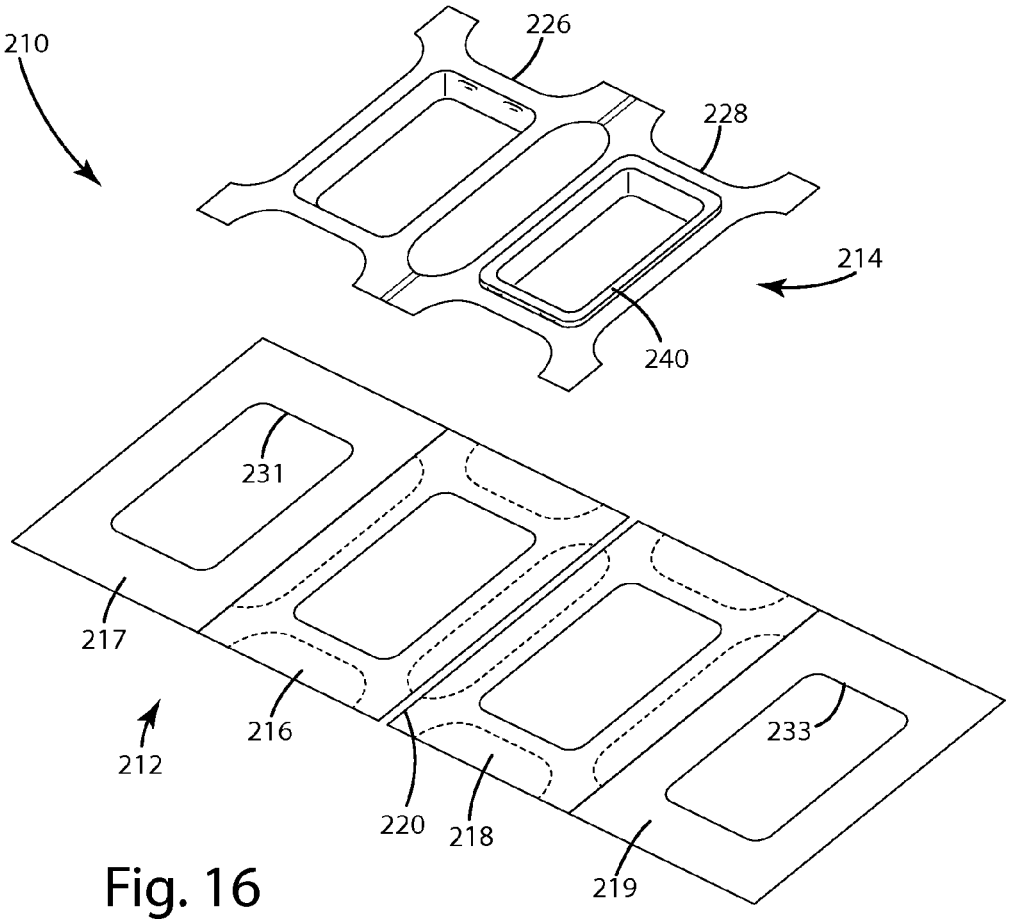
FIG. 16 is a perspective view of a further alternative package having a plastic portion with a double hinge showing the plastic portion positioned above the paperboard panels.
Figure 17:
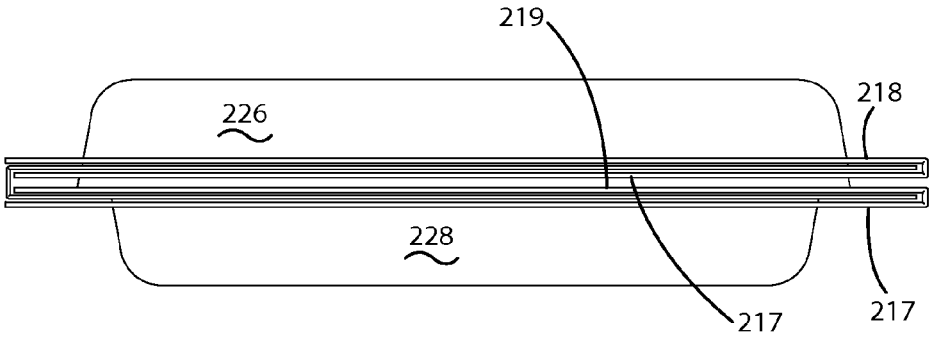
FIG. 17 is a front view of the alternative package of FIG. 16.

Referring now to FIGS. 16 and 17, the package 210" may include a paperboard portion 212" that has two separate parts. As shown in FIG. 16, panels 216" and 217" may be separate from panels 218" and 219". For example, in this embodiment, panels 216" and 217" are formed from one piece of paperboard that is divided into two panels by a fold line, and panels 216" and 217" are formed from a separate piece of paperboard that is also divided into two panels by a fold line. In this embodiment, panels 216" and 217" may be closed about plastic compartment 226" and panels 218" and 219" may be closed about plastic compartment 228". As a result, the package 210" of this embodiment hinges between open and closed positions about the fold line 225" and 227" extending through the segments which join the two plastic compartments 226" and 228". In this embodiment, the panels 216", 217", 218" and 219" may be secured to the plastic portion 214" by essentially any suitable mechanism. For example, a cohesive coating on the inside surfaces of each of panels 216" and 217" may be used to join them together about component 226", and a cohesive coating on the insider surfaces of each of panels 218" and 219" may be used to join them together about plastic component 228". Although the cohesive coating may not adhere directly to the plastic components 226" and 228", the adhesive bond between the panels 216", 217", 218" and 219" may be used to trap the plastic components 226" and 228" in place. Alternatively other types of adhesive or mechanical structures, such as staples, may be used to join the panels with the plastic portion 214". These alternative adhesives or mechanical structures may join the plastic portion 214" directly to the paperboard portion 212" or may simply join the paperboard panels about the plastic components to trap them in place.

In this embodiment, the plastic portion 214" is shown with a pair of fold lines extending through each segment 225" and 227" that cooperate to provide the package with a square hinge (see FIG. 17). The plastic portion 214" may have essentially any alternative type of hinge, such as a single score line, a cut line or a series of perforations. As with the embodiment of FIGS. 14 and 15, the spacing between fold lines in the plastic portion 214" may be selected to accommodate the combined thickness of panels 217" and 219". In this embodiment, the two plastic compartments 226" and 228" are joined to one another along a pair of spaced-apart segments. The configuration may, however, vary as desired. For example, the two plastic components 226" and 228" may be joined along a different number of segments or along the entire length of the two components.

Figure 18:
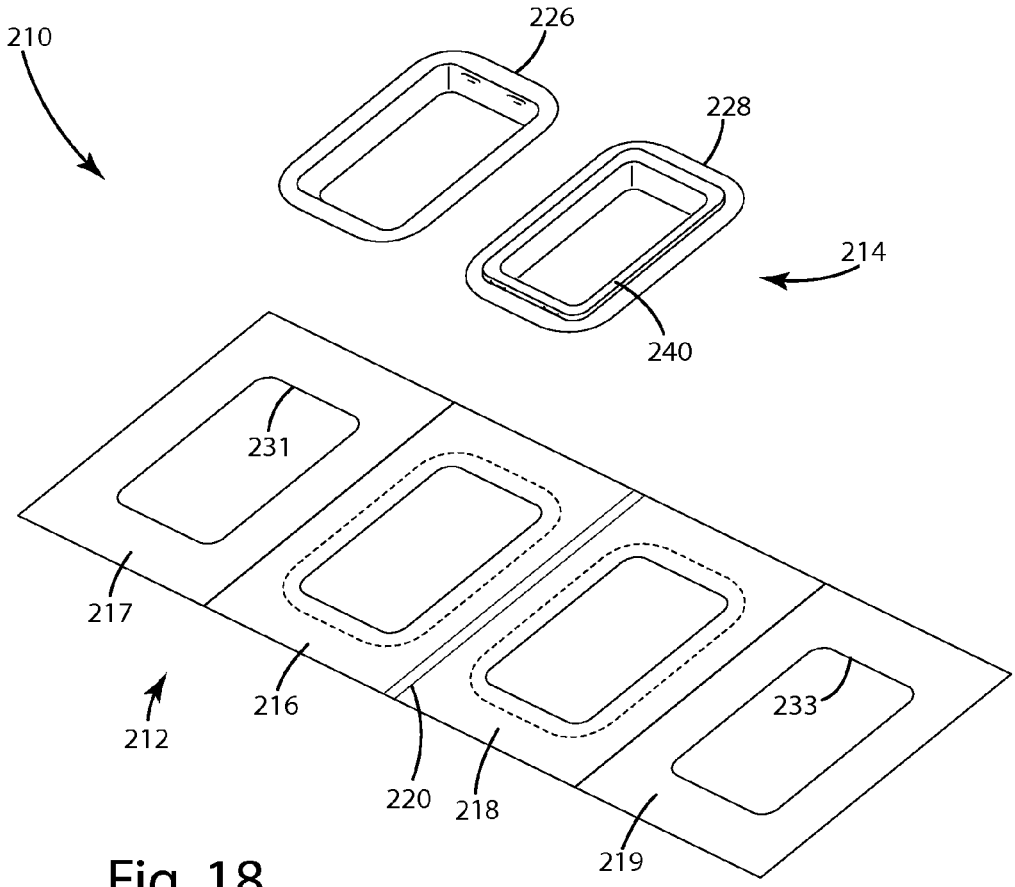
FIG. 18 is a perspective view of a further alternative package having a plastic portion with separated plastic components showing the plastic components positioned above the paperboard panels.
Figure 19:
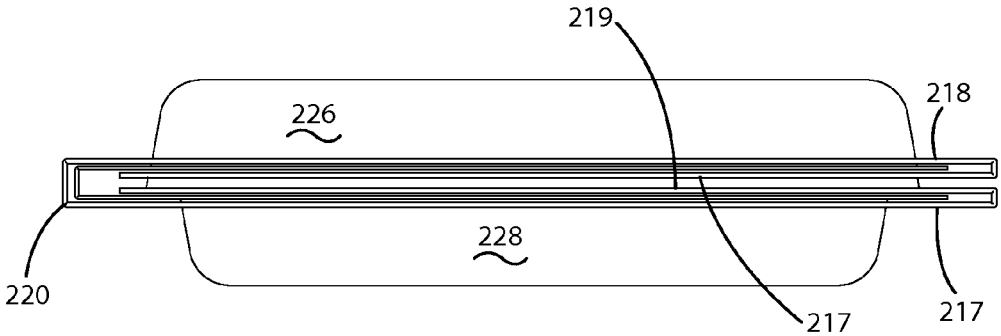
FIG. 19 is a front view of the alternative package of FIG. 18.

Another alternative embodiment is shown in FIGS. 18 and 19. In this embodiment, the plastic portion 214' includes two separate components 226' and 228'. As shown in FIG. 18, the plastic components 226' may be configured to be fitted between and carried by the panels 216' and 217', and plastic component 228' may be configured to be fitted between and carried by panels 218' and 219'. Each plastic component 226' and 228' may include a peripheral flange that can be sandwiched between the corresponding paperboard panels 216', 217', 218' and 219'. The size, shape and configuration of the flanges may vary from application to application. For example, the flanges need not be continuous and may extend along only portions of the periphery of the plastic components.

In this embodiment, the package 210' hinges between open and closed positions about the fold line 220' in paperboard portion 212'. In this embodiment, the paperboard portion 212' is shown with a pair of fold lines 220' that cooperate to provide the package with a square hinge (see FIG. 19). The paperboard portion 212' may, however, have essentially any alternative type of hinge, such as a single score line, a cut line or a series of perforations. The spacing between fold lines may be selected to accommodate the combined thickness of panels 217' and 219' and the flanges of the plastic components 226' and 228'.

In this embodiment, the panels 216', 217', 218' and 219' may be secured to the plastic components 226' and 228' by essentially any suitable mechanism. For example, a cohesive coating on the inside surfaces of each of panels 216' and 217' may be used to join them together about component 226', and a cohesive coating on the insider surfaces of each of panels 218' and 219' may be used to join them together about plastic component 228'. Alternatively other types of adhesive or mechanical structures, such as staples, may be used to join the paperboard portion 212' with the plastic components 226' and 228'. These alternative adhesives or mechanical structures may join the plastic components 226' and 228' directly to the paperboard portion 212' or may simply join the paperboard panels about the plastic components to trap them in place.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular. It is to be understood that the invention disclosed and defined herein extends to all alternative combinations of two or more of the individual features mentioned or evident from the text and/or drawings. All of these different combinations constitute various alternative aspects of the present invention.

The invention claimed is:

1. A composite package comprising:

a first package component including a first flange and a raised pocket extending from said first flange;

a second package component configured to selectively interlock with said first package component by frictional interfit, said first package component and said second package component shaped to cooperatively define an article containing space;

a first panel joined to said first package component and including a first opening for receipt of said raised pocket therethrough; and a second panel joined to said second package component and joined to said first panel along a first hinge, wherein the package is movable between a closed position in which said first package component releasably interlocks with said second package component to cooperatively define said article containing space, and an open position in which said first package component and said second package component are separated to provide access to an interior of said article containing space, wherein the package is repeatedly moveable between said closed position and said open position without damaging said first and second panels.

2. The composite package of claim 1 wherein said second package component includes a shoulder and said first package component includes a seat, said seat configured to frictionally receive said shoulder when said package portion is in said closed position.

3. The composite package of claim 2 wherein said seat includes a sidewall and a base, said sidewall and said base being configured to abut said shoulder when said first package component and said second package component are interfitted.

4. The composite package of claim 1 further including a third panel joined to said first panel along a second hinge, said third panel being secured in overlying relationship to said first panel to sandwich said first flange therebetween.

5. The composite package of claim 4 wherein said third panel defines a third opening aligned with said first opening in said first panel.

6. The composite package of claim 4 wherein further including a fourth panel joined to said second panel along a third hinge, said fourth panel being secured in overlying relationship to said second panel to secure said second package component therebetween.

7. The composite package of claim 6 wherein said second panel includes a second opening in alignment with a fourth opening in said fourth panel.

8. A composite package comprising:

a paperboard portion having a first panel and a second panel, said first panel being joined to said second panel along a first hinge, said first panel defining an opening;

a first package component carried by said first panel, said first package component including a first flange secured to said first panel and a first raised pocket extending through said first panel opening;

a second package component carried by said second panel, said second package component being configured to selectively interlock with said first package component by frictional interfit, said first package component and said second package component shaped to cooperatively define an article containing space when interfitted with one another; and wherein the package is movable between a closed position in which said first package component releasably interlocks with said second package component to cooperatively define said article containing space and an open position in which said first package component and said second package component are separated to provide access to an interior of said article containing space, wherein the package is repeatedly moveable between said closed position and said open position without damaging said paperboard portion.

9. The composite package of claim 8 wherein said paperboard portion includes a third panel joined to said first panel along a second hinge, said third panel secured in overlying relationship to said first panel to sandwich said first flange therebetween.

10. The composite package of claim 9 wherein said second package component including a second flange and wherein said paperboard portion includes a fourth panel joined to said second panel along a third hinge, said fourth panel secured in overlying relationship to said second panel to sandwich said second flange therebetween.

11. The composite package of claim 8 wherein said first flange extends around at least a portion of a periphery of said first raised pocket.

12. The composite package of claim 8 wherein said second package component includes a second raised pocket, said second flange extending around at least a portion of a periphery of said second pocket, said second raised pocket extending through an opening in said second panel.

13. The composite package of claim 8 wherein at least one of said first package component and said second package component includes a shoulder and the other of said first package component and said second package component includes a seat, said seat configured to frictionally receive said shoulder when said paperboard portion is in said closed position.

14. The composite package of claim 13 wherein said seat includes a sidewall and a base, said sidewall and said base being configured to abut said shoulder when said first package component and said second package component are interfitted.

15. The composite package of claim 8 wherein said paperboard portion is a single continuous piece of paperboard and said first panel is joined to said second panel along a hinge.

16. A composite package comprising:

a first panel joined to a second panel along a first hinge and joined to a third panel along a second hinge, said first and second panels each including an opening;

a first package component carried between said first panel and said second panel, said first package component including a raised pocket extending through said opening in said first and second panels;

a second package component configured to selectively interfit with said first package component, said first package component and said second package component shaped to cooperatively define an article containing space when interfitted with one another; and wherein the package is movable between a closed position in which said first package component releasably interlocks with said second package component to cooperatively define said article containing space, and an open position in which said first package component and said second package component are separated to provide access to an interior of said article containing space, wherein the package is repeatedly moveable between said closed position and said open position without damaging said first, second and third panels.

17. The composite package of claim 16 wherein said second package component is joined to said third panel.

18. The composite package of claim 16 wherein said second package component includes a shoulder and said first package component includes a seat, said seat being configured to frictionally receive said shoulder when said package is in said closed position.

19. The composite package of claim 18 wherein said seat includes a sidewall and a base, said sidewall and said base being configured to abut said shoulder when said first package component and said second package component are interfitted.

20. The composite package of claim 16 wherein said first panel, said second panel, and said third panel form a single continuous piece of paperboard.

* * * * *